United States Patent [19]

Lewis

[11] Patent Number: 4,562,878

[45] Date of Patent: Jan. 7, 1986

[54] ELECTROMAGNETIC SHAPING OF THIN SEMICONDUCTOR RIBBON STRIP CAST ONTO A CHILL BLOCK

[75] Inventor: Brian G. Lewis, Branford, Conn.

[73] Assignee: Olin Corporation, New Haven, Conn.

[21] Appl. No.: 584,222

[22] Filed: Feb. 27, 1984

[51] Int. Cl.[4] ..... B22D 11/06

[52] U.S. Cl. ..... 164/467; 164/463

[58] Field of Search ..... 164/423, 463, 467, 503

[56] References Cited

U.S. PATENT DOCUMENTS

| | | | |
|---|---|---|---|
| 3,096,158 | 7/1963 | Gaule et al. | 422/246 |
| 3,862,658 | 1/1975 | Bedell | 164/87 |
| 4,150,706 | 4/1979 | Reiniche et al. | 164/49 |
| 4,262,734 | 4/1981 | Liebermann | 164/423 |
| 4,339,508 | 7/1982 | Tsuya et al. | 164/429 |
| 4,373,571 | 2/1983 | Yarwood et al. | 164/467 |
| 4,419,177 | 12/1983 | Pryor et al. | 164/469 |
| 4,448,236 | 5/1984 | Kimora | 164/463 |
| 4,479,528 | 10/1984 | Maringer | 164/423 |
| 4,484,614 | 11/1984 | Maringer | 164/463 |

FOREIGN PATENT DOCUMENTS

| | | | |
|---|---|---|---|
| 56-62621 | 1/1982 | Japan . | |
| 56-23596 | 8/1982 | Japan . | |
| 5575329 | 11/1982 | Japan . | |
| 622725 | 4/1981 | Switzerland | 164/463 |

*Primary Examiner*—Francis S. Husar
*Assistant Examiner*—Jorji M. Griffin
*Attorney, Agent, or Firm*—Howard M. Cohn; Barry L. Kelmachter; Paul Weinstein

[57] ABSTRACT

This application is directed to an apparatus and process for producing a thin ribbon of semiconductor material. The apparatus includes a moving chill block. The material is deposited in a molten state onto the chill block. A device for generating a magnetic field shapes the deposited molten material on the chill block into the thin ribbon strip.

32 Claims, 5 Drawing Figures

ELECTROMAGNETIC SHAPING OF THIN SEMICONDUCTOR RIBBON STRIP CAST ONTO A CHILL BLOCK

This application relates to U.S. patent application Ser. No. 584,281 entitled "Electromagnetic Shaping of Thin Ribbon Semiconductor Strip on a Chill Wheel" by Lewis et al.

While the invention is subject to a wide range of applications, it is especially suited for producing high quality, thin ribbon strip at a relatively slow casting rate and will be particularly described in that connection.

In conventional chill-block spinning, a metal jet impinges on a cold moving surface where it is reshaped and solidified. Chill blocks of various geometries, including concave and convex discs, cylinders and drums have been employed in the prior art. A typical example of this technique is disclosed in U.S. Pat. No. 4,339,508 to Tsuya et al. which discloses a method for manufacturing a thin and flexible ribbon of super conductor material.

Generally, chill block casting requires rapid quenching techniques and high casting rates. For example, In U.S. Pat. No. 4,262,734 to Liebermann, the substrate wheel rotates at a linear velocity of between 10 meters/-second to 50 meters/second. Although this high speed may be required for rapid solidification associated with high speed casting, it generally provides microstructure which is unacceptable for certain applications contemplated by the present invention.

A different approach for depositing a molten alloy on a chill wheel is disclosed in Japanese Application No. 55-75329 entitled "Production Of Quickly Solidified Material". The molten material is conducted "to the surface of a rotary cooling body by means of electromagnetic force". By quickly cooling the molten alloy on the body, a thin, continuous strip is produced. The electromagnetic force is generated by an electromagnetic pump which is quite different from the present invention where the molten material is delivered by gravity feed or pressure and the electromagnetic forces shape the melt on the chill wheel.

During the cooling of the molten material on the chill wheel, it is desirable to shape the liquid melt as required. In the past this has been done by techniques such as shaping the wheel into different configurations and prolonging the contact of the melt on the wheel as disclosed in U.S. Pat. No. 3,862,658 to Bedell. In that patent, the period of contact may be prolonged by use of such devices as gas jets, moving belts or rotating wheels.

Another technique for shaping the melt is disclosed in Japanese Patent Application No. 56-23596 entitled "Production Of Solid Solution Quick Cooling Material". A corona discharge is generated between an electrode and the injection material on the surface of a cooling roll. The result is a quick-cooled material of a thin shape.

A technique of shaping the melt prior to contact with the chill wheel is disclosed in U.S. Pat. No. 4,150,706 to Reiniche et al. A jet of liquid metal is given a reciprocating movement in various ways so that the final strip has an undulated shape. For example, the jet is arranged to pass through a constant magnetic field which induces a variable alternating force on the jet prior to its contact with the chill wheel. This differs from the present invention where the final shaping of the molten material occurs on the surface of the chill wheel. Further, the patent does not disclose both melting and shaping the molten material prior to its contact with the chill wheel.

The quality of the molten metal being shaped can be controlled as disclosed in Japanese Patent Application No. 56-62621 entitled "Production Of Metallic Plate". The purpose is "To increase viscosity and to improve homogenization and surface characteristic in the case of bringing molten metal into contact with a moving heat transmitting surface and cooling the same quickly by forming a magnetic field intersecting orthogonally with the advancing direction thereof with said metal." The permanent magnetic field disclosed in this patent functions in a completely different manner than the electromagnetic shaping field associated with the chill block of the present invention.

It is a problem underlying the present invention to provide a casting technique where relatively slow solidification rates are possible and the shape of the final thin strip can be regulated.

It is an advantage of the present invention to provide an apparatus for producing thin ribbon strip from molten material which obviates one or more of the limitations and disadvantages of the described prior arrangements.

It is a further advantage of the present invention to provide an apparatus for producing a thin ribbon strip which allows for relatively slow solidification rates.

It is a yet further advantage of the present invention to provide an apparatus for producing a thin ribbon strip wherein electromagnetic shaping of the melt occurs on the chill wheel.

It is a yet further advantage of the present invention to provide an apparatus for producing a thin ribbon strip which is relatively inexpensive to manufacture.

Accordingly, there has been provided an apparatus and process for producing a thin strip from molten material. Molten material is deposited onto a first location of a rotating chill wheel. A thin ribbon strip is pulled from a second location on the chill wheel downstream from the first location. A magnetic field is produced adjacent the chill wheel for shaping the deposited molten material on the chill wheel into the thin ribbon strip.

The invention and further developments of the invention are now elucidated by means of the preferred embodiments shown in the drawings.

Figure 1:
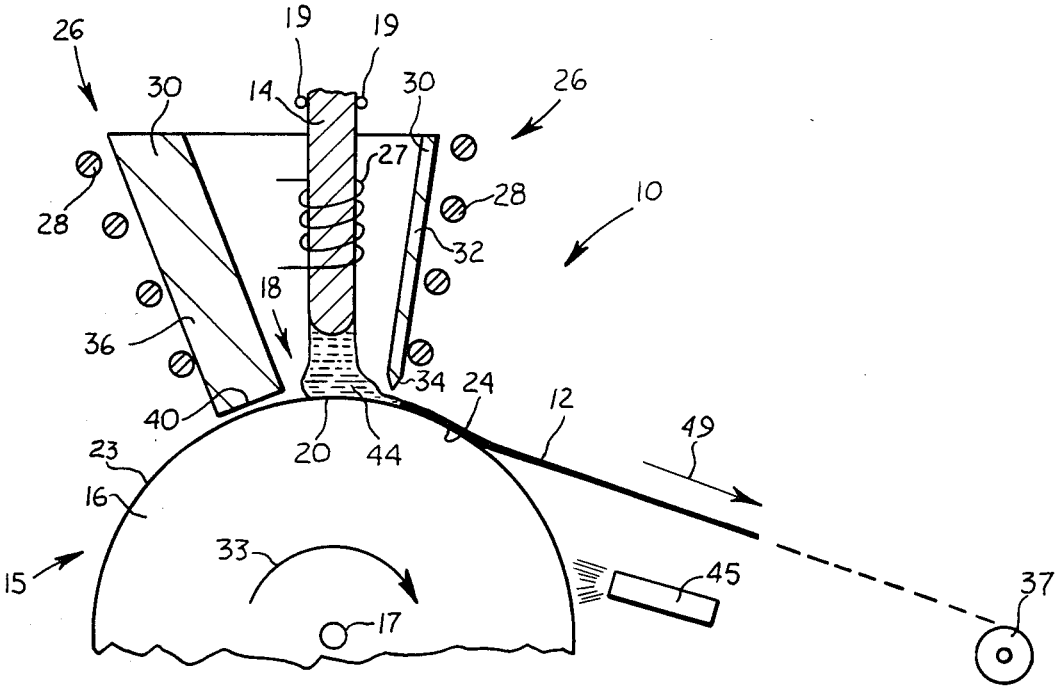
FIG. 1 is a schematic representation of a chill wheel casting apparatus in accordance with the present invention.

Referring to FIG. 1, there is illustrated an apparatus 10 for producing a thin ribbon strip 12 from a melt of material 14. The apparatus includes a chill block 15 and a device 18 for depositing the molten material onto the chill block 15. A magnetic field producing device 26 adjacent the chill wheel shapes the deposited molten material on the chill wheel into the thin ribbon strip.

The present invention is particularly directed to providing efficient and controllable heat removal from the shaping region using a solid chill block or wheel. As will be further elaborated below, the apparatus of this invention is a novel combination of electromagnetic shaping and chill casting. FIG. 1 is a schematic diagram showing an embodiment for casting a semiconductor ribbon or strip, such as a silicon ribbon. A desired material 14 in a molten condition is fed onto or extracted by the moving chill wheel 16. As the molten material, e.g. silicon, passes through a first electromagnetic field generated by a coil 28 and a flux concentrator 30, shaping is provided by the electromagnetic field interaction and solidification occurs by heat extraction through the wheel. The control of the solidification has particular advantages in producing materials for solar cell and electronic applications. These applications frequently require a large grained material with through section grain growth. Ideally, a single crystal material is formed by initially seeding the ribbon.

There are two particular advantages of the apparatus and process which are disclosed in the present invention. First, the latent heat in the molten material and the induced heat, i.e. from the electromagnetic containment force, can both be extracted by the chill wheel. Second, the rate of heat removal can be controlled by the speed of the chill wheel, the selecting of the wheel material, and/or the wheel temperature. Each of these variables are selected in accordance with the particular material being cast as well as the final shape and crystal structure desired.

The chill wheel may be of any desired diameter and may be rotated about its center 17 at a peripheral speed of about 10 centimeters/minute to about 30 centimeters/minute and preferably about 15 centimeters/-minute to about 25 centimeters/minute. The wheel may be made of any material which is stable during contact with the melt such as, for example, steel or copper. Also, the wheel may be formed of a material which is chrome plated or provided with a ceramic coating.

Figure 3:
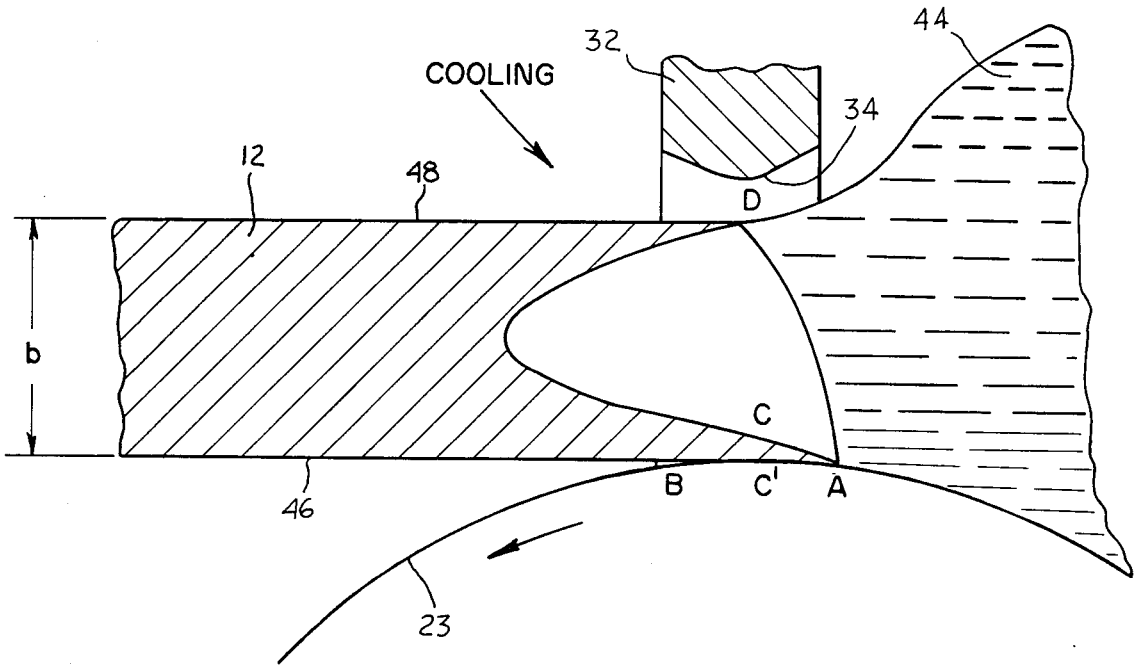
FIG. 3 is a cross-sectional side view of the solidification of molten material.
Figure 2:
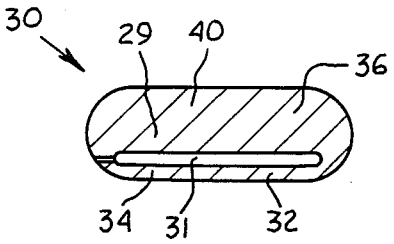
FIG. 2 is a cross-sectional view of a flux concentrator in accordance with the present invention.

The melt may be applied to the surface 23 of the wheel by any conventional technique such as with a feed rod as shown or through a tube with a nozzle of desired diameter at one end. The feed rod may be melted by any conventional means such as a heating coil with or without a susceptor like R-F coil 27 around the feedstock, resistive heating, or a direct energy source. A number of important differences distinguish the present invention from the prior art techniques associated with chill block casting. One particular difference relates to the electromagnetic shaping performed by the magnetic field producing device 26. As shown in FIGS. 1 and 2, this device may comprise an inductor coil 28 disposed about a flux concentrator 30, The side walls of concentrator 30 flares outward from its bottom or base surface 29 which is disposed adjacent the chill wheel. A substantially oval slot 31 through which the molten material passes onto the wheel is formed in the base 29. Upstream and downstream side walls 36 and 32, respectively, flare outward from the bottom surface 29 away from the chill wheel. The thinner side wall 32, downstream from the point of melt deposition, has a bottom surface 34 which may be slightly curved as best seen in FIG. 3. By contrast, opposite upstream wall 36 may be substantially thicker than side wall 32 and have a substantially flat bottom surface 40. As in any typical concentrator, the second electromagnetic field from the inductor coil 28 induces a current in the body of the concentrator which flows around the slot 31, i.e. the section of least electrical resistance. The disclosed flux concentrator is shaped so that the magnetically derived force dams up the molten material behind the downstream curved surface 34 and presses the molten material into a strip of desired thickness 12 under the side wall 32. The upstream side wall 36 provides very good capacitive coupling between its bottom surface 40 and the surface 23 of the chill wheel 16. These features will be further elaborated on hereinbelow. It is also within the terms of the present invention to substitute a concentrator of any desired configuration in accordance with the principles set forth in U.S. Pat. Nos. 3,096,158 to Gaule et al. and 4,373,571 to Yarwood et al. Once the strip is formed and partially solidified on the chill wheel, it is taken up from location 24 by any desired means, such as a coiling wheel 37.

To more fully understand the present invention, an analysis of the process by which the silicon feed rod 14 is converted to a thin strip 12 follows. First, the material 14 may be melted into a drop of melt 44, and deposited at a first location 20 of the chill wheel 16. The melting may be accomplished by any desired conventional technique and preferably without contact between the feed rod and the heating device so that purity of the melt may be maintained. As the feed rod becomes very hot or molten, the electromagnetic field from the coils 28 couples with the material and further heats the material. The drop of molten material 44, deposited upon the surface 23, is primarily held together by surface tension and extends substantially the width of aperture 31 within concentrator 30. The material is fed by wheels 19 at a slow enough speed so that it must first flow in the direction of rotation, indicated by arrow 33, toward the downstream wall 32 of the concentrator. The electromagnetic force field between the wheel and the surface 23 acts to limit material flow. In addition, the strength of the magnetic field at the surface 34 determines the thickness of the strip.

The stages of solidification are illustrated in FIG. 3. The melt begins to solidity from the surface of the chill wheel upwards towards the concentrator because of the heat transfer from the melt into the chill wheel. If the heat transfer coefficient at the interface is such that the heat transfer is too efficient, the material will solidify prior to any shaping. On the other hand, if the heat transfer is too inefficient, the material will not completely solidify within the containment region and not form the desired shaped strip. The chill block may be cooled by any conventional means such as applying a coolant through a cooling manifold 45 to the surface of the chill block. It is also within the terms of the present invention to use any desired cooling means.

It is important that the top surface 48 of the ribbon 12 be at least partially solidified before the strip leaves the chill wheel. If this is not achieved under ambient conditions, it is within the scope of this invention to apply top cooling in any conventional manner such as, for example, applying a nonreactant cooling gas to the top surface 48 of the strip. The preferred embodiment has the solidification parameters selected whereby a solid shell is formed on the top and bottom of the strip just before it exits the electromagnetic containment zone.

An important consideration is the ability to form large grain material with the grains essentially normal to the casting direction (indicated by arrow 49). This may be achieved by having the solidification move in an upward direction away from the chill wheel towards the top surface 48. This allows the grains to grow from the bottom into the liquid. Further, it is desired that the growth rate be rather slow. This implies that the top of the melt must remain relatively molten in order that the grain growth can move upward. The top surface is conveniently heated by the electromagnetic field produced by the concentrator. The amount of heat applied at a given containment load may be controlled by varying frequency of the current applied to the inductor coil 28.

The selection of the frequency of the inductor current and its ability to define the dimensions of the strip as well as control the solidification rate is a critical aspect of the present invention and one which differentiates the present invention from the prior art. The method of using a chill wheel for solidifying a stream of melt into a thin ribbon, as applied in the present invention, is not conventional melt spinning. Melt spinning uses the momentum associated with casting speed and heat transfer from the ribbon to define the ribbon dimensions. By contrast, the present invention has a relatively low casting speed and does not use the wheel momentum to define the ribbon dimensions. Instead, the dimensions of the strip 12 are defined by the strength of the electromagnetic containment field. Note that the width of the strip may be substantially equal to the width of the wheel. Further, the electromagnetic energy is a primary control of the solidification rate. By choice of frequency, one may control the amount of heat being pumped into the strip and thereby vary the time required for the solidification of the melt. Basically, the effect of the electromagnetic field is distributed between the pressure which squeezes the molten material into the strip and the heat generated in the strip. By selecting the frequency of the inductor current and the thickness of the thin strip via power level and concentrator proximity, the ratio of squeezing pressure to heat generation may be controlled. Preferably, the strip thickness is such that all of the energy of the electromagnetic field is dissipated in the silicon strip. This prevents penetration of the energy into the wheel where it is directly dissipated.

The skin depth is represented by the following formula:

$$\delta = \sqrt{\frac{\rho}{\mu_o \pi f}}$$

where $\delta$=penetration depth, $\rho$=the electrical resistivity of material, $\mu_o$=permeability of free space, the relative permeability $\mu_r$ of materials of interest being unity, f=frenquency of current and $\pi \sim 3.14$. The penetration depth is the depth of material from the outer surface through which the current density has an approximate exponential decay of about 63% as compared to the current at the outer surface. Twice the penetration depth, i.e. $2\delta$, is the depth of material at which the current density has an approximate decay of about 86% as compared to the surface.

In practicing the present invention, the strip thickness is chosen to be about 1 and $4\delta$ and preferably about $2\delta$. If the skin depth is much less than $2\delta$, the strip will be partially transparent to the field. Power dissipation is complicated by the existance of the interface between the ribbon and the semi-infinite chill surface. Owing to the possible resistivity change between the melt and the wheel, there will be electromagnetic reflections at the interfaces that can lead to a local peak in the induced current and an associated sharp rise in the dissipated power. To prevent this heat management problem, the strip thickness may be chosen to prevent penetration of the electromagnetic field into the wheel or the resistivity of the melt may be matched with the resistivity of the wheel so as to prevent the generation of local peak currents. The thin strip of the present invention is preferably between about 0.1 to about 3 mm thick and more preferably between about 0.5 to about 1.0 mm thick.

Although silicon has been primarily described as the material of interest, the invention may be used for any metal, semi-metal, metalloid or especially hard refractory metals which are difficult to form into thin strip.

Besides the embodiment shown using a chill wheel 16, it is also within the terms of the present invention to use a different device such as an endless belt. Further, the concentrator may be of any desired shape and may be substituted for by any suitable device for creating an electromagnetic force field in the appropriate sense.

In practice, the exemplary operating parameters for the silicon casting system illustrated in FIG. 1 may be ascertained.

For the reasons mentioned above, to avoid significant power loss into the chill wheel, the ribbon thickness b, see FIG. 3, should be approximately twice the skin depth $\delta$. Taking $b \sim 2\delta$, the desired operating frequency f for the inductor current is given by:

$$f = \frac{\rho}{\mu_o \pi \delta^2} = \frac{4\rho}{\mu_o \pi b^2}$$

For silicon the resistivity p is $\mathbf{80 \times 10^{-6}}\Omega$ cm. Choosing b=0.1 cm as an upper limit on ribbon thickness $$f = \frac{80 \times 10^{-6}\ \Omega \cdot \text{cm} \times 4}{4\pi \times 10^{-9}\ \Omega \cdot \text{sec} \cdot \text{cm}^{-1} \times \pi(0.1\ \text{cm})^2} = 8 \times 10^5\ \text{Hz}$$

Thinner ribbon could be produced by using higher frequencies. Using the above relationship, casting of 0.04 cm ribbon would require a frequency of 5 MHz.

Satisfactory control of shaping depends on the rate of solidification of the ribbon. Premature freezing of the melt in contact with the chill wheel prevents proper shaping while insufficient shell formation results in the relaxation of the ribbon geometry under the influence of surface forces on exiting from the current concentrator 30. The limits on acceptable solidification front position are shown schematically in FIG. 3. A solidification front sharper than AD, i.e. in the upstream direction, limits shaping capabilities while a shallow front AC must be sufficient to freeze a rigid shell of thickness CC' of, for example, 0.001 cm. The heat flow conditions for this arrangement indicate that speeds of about 20 cm./minute should be attainable in casting silicon ribbon with a thickness of 0.1 cm. This compares very favorably with the practical limit of 4 cm./minute achieved by ribbon casting apparatus now in commercial use. The present invention also has the additional advantage that fine control over the solidification conditions required to produce a quality single crystal product can be exercised by adjustments to both the casting speed, the ambient temperature of the chill surface and the provisions of any necessary seeding crystal.

Figure 4:
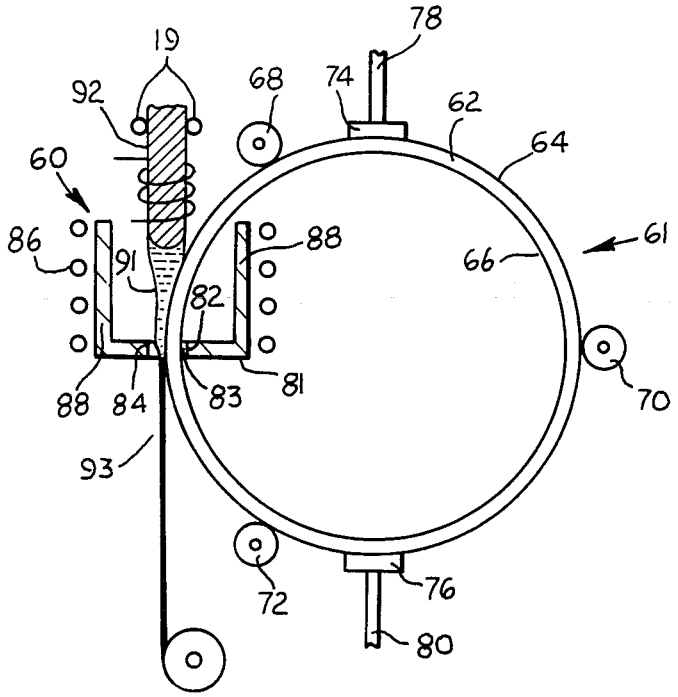
FIG. 4 is a schematic representation of a second embodiment of the present invention.

Referring to FIG. 4, there is indicated a second preferred embodiment of the present invention which primarily differs from the first embodiment of FIG. 1 in regards to the shape of the flux concentrator 60 and the chill block 61. The chill block in this embodiment is preferably and generally described as a chill wheel 62.

However, it is within the scope of the present invention for the chill block to comprise any moving structure, such as a movable circular or oval belt or a flat surface. The chill wheel is formed of a moving, circular frame structure having outer and inner surfaces 64 and 66, respectively. The chill wheel 62 is supported by three rotating wheels 68, 70 and 72. They are preferably located at approximately 120° apart from each other and contact the outer surface 64 of the chill wheel so as to rotate it at any desired speed. Additionally, these wheels may be used as surface wipers and/or substrate cooling points. Although three wheels are shown, it is also within the scope of the present invention to use any number of wheels as desired. Further, any other conventional means, such as wheels contacting inner surface 66, may be used to rotate the chill wheel. The chill wheel is cooled by any conventional means such as providing slip ring collars 74 and 76 at either end. The slip ring collars are affixed to the wheel so that the wheel 62 may rotate through them and allow a coolant to flow into the wheel through pipe 78 and out the wheel 62 through pipe 80. The chill wheel may be cooled by other conventional means such as directly applying a coolant to either surface of the chill wheel or by any other desired technique.

Figure 5:
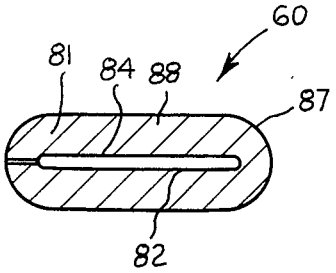
FIG. 5 is a cross-sectional view of the flux concentrator of FIG. 4.

The flux concentrator is preferably disposed on either side of the circular frame so that the chill wheel may rotate through the concentrator. The concentrator, as seen in cross section in FIG. 5, includes a base 81 having a substantially oval slot 83 therein. Two sides of the slot are inner surfaces 82 and 84 of base 81. These surfaces are generally disposed parallel and opposite to one another. An inductor coil 86 is wound about the perimeter of the vertical wall 88 which extends longitudinally with the direction of casting from the base 81. The molten material 91 may be delivered onto the chill wheel from a feed rod 92. As with the feed rod 14 of the first embodiment, the rod 92 may be heated to form the melt 91 by any conventional means such as inductive, radiative or irradiation. The molten material 91 contacts the surface 64 of wheel 62 and flows through the slot 83. As in the first embodiment of FIG. 1, the concentrator 60 concentrates the induced current from inductor coil 86 into the slot 83. The resulting magnetic force field shapes the melt against the surface 64 of the wheel into the desired thin strip shape. The selection of the proper inductor frequency, solidification rate, and thickness of the final strip 93 may be determined in accordance with the description of their selection described with regards to the embodiment illustrated in FIG. 1.

The patents and patent applications set forth in this application are intended to be incorporated by reference herein.

It is apparent that there has been provided in accordance with this invention a chill block with an electromagnetic field associated therewith and a method for using this apparatus for forming molten material into thin strip which fully satisfy the objects, means, and advantages set forth hereinabove. While the invention has been described in combination with the specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An apparatus for producing a thin ribbon of material, comprising:

a moving chill block;

means disposed adjacent the chill block for depositing said material in a molten state onto said chill block; and means adjacent said chill block for generating a first electromagnetic field to apply pressure to the molten material to squeeze the deposited molten material against said chill block into said thin ribbon of material.

2. The apparatus as in claim 1 wherein the first electromagnetic field generating means includes an inductor for generating a second electromagnetic field.

3. The apparatus as in claim 2 wherein said first magnetic field generating means further comprises a flux concentrator disposed within the second electromagnetic field whereby a current is induced and concentrated in the concentrator so as to generate the first electromagnetic field for shaping the molten material into molten thin ribbon.

4. The apparatus as in claim 3 wherein said concentrator comprises a base member adjacent said chill block having a slot therein in which said first field is concentrated, and through which said molten material flows onto said chill block, said concentrator further comprising first and second side walls disposed on the upstream and downstream edges of said slot respectively and flared outward from said base member.

5. The apparatus as in claim 4 wherein the bottom surface of said downstream side wall directs the first electromagnetic field against the molten material so as to squeeze the molten material against the chill block to form the desired thin ribbon.

6. The apparatus as in claim 5 wherein said bottom surface is curved.

7. The apparatus as in claim 4 wherein the upstream side wall is disposed adjacent said chill block and compacitively coupled to said chill block.

8. The apparatus as in claim 7 wherein said second side wall is thicker than said first side wall.

9. The apparatus as in claim 4 further including means for heating the material to the molten state.

10. The apparatus as in claim 9 wherein said chill block comprises a chill wheel.

11. The apparatus as in claim 10 further including coiling means for pulling thin solidified ribbon from said chill wheel.

12. The apparatus as in claim 9 further including cooling means associated with said chill wheel for solidifying the molten strip on the chill block onto a thin ribbon.

13. The apparatus as in claim 3 wherein said chill block comprises a moving frame, and said flux concentrator comprising a base member with a slot therein, said base member being disposed substantially transverse to the direction of casting to allow said frame to move through said slot.

14. The apparatus as in claim 13 wherein said induced current is concentrated about the slot causing said first electromagnetic field to be concentrated within said slot so that said molten material passing through said slot is squeezed against the surface of said chill block and formed into said desired thin ribbon.

15. The apparatus as in claim 14 wherein said slot has an oval shape.

16. The apparatus as in claim 15 wherein said flux concentrator further comprises a side wall adjoined to the edge of said base member extending upstream and parallel to the direction of casting from the chill block, and said inductor comprising a coil disposed about the outer periphery of said side wall for inducing a current in said side wall which is concentrated about said slot.

17. The apparatus as in claim 16 wherein said moving frame comprises a chill wheel.

18. The apparatus as in claim 16 further including cooling means associated with said chill block for solidifying the molten ribbon on the chill block into a thin ribbon.

19. The apparatus as in claim 18 further including coiling means for pulling the solidified thin ribbon from said chill block.

20. The apparatus as in claim 1 wherein said chill block comprises a moving frame, and said flux concentrator comprises a base member with a slot therein, said base member being disposed substantially transverse to the direction of casting to allow said frame to move through said slot.

21. The apparatus as in claim 20 wherein said induced current is concentrated about the slot causing said first electromagnetic field to be concentrated within said slot so that said molten semiconductor material passing through said slot is squeezed against the surface of said chill block and formed into said desired thin semiconductor ribbon.

22. An apparatus for producing a thin ribbon of semiconductor material, comprising:

a moving chill block;

means disposed adjacent the chill block for depositing said semiconductor material in a molten state onto said chill block; and means adjacent said chill block for generating a first electromagnetic field to apply pressure to the molten material to squeeze the deposited molten semiconductor material against said chill block into said thin ribbon.

23. The apparatus as in claim 22 wherein the first electromagnetic field generating means includes an inductor for generating a second electromagnetic field.

24. The apparatus as in claim 23 wherein said first magnetic field generating means further comprises a flux concentrator disposed within the second electromagnetic field whereby a current is induced and concentrated in the concentrator so as to generate the first electromagnetic field for shaping the molten material into said thin semiconductor ribbon.

25. A process for producing a thin ribbon of material, comprising the steps of:

providing a moving chill block;

depositing said material in a molten state onto said chill block;

generating a first electromagnetic field for applying pressure to shape the deposited molten material on said chill block into said thin ribbon; and squeezing the molten material against said chill block with the pressure of the first electromagnetic field to form said thin ribbon.

26. The process as in claim 25 further including the step of providing an inductor for generating a second electromagnetic field.

27. The process as in claim 26 further including the step of disposing a flux concentrator having a slot therein within the second electromagnetic field whereby a current is induced and concentrated about the slot in the concentrator so as to generate the first electromagnetic field within the slot for shaping the molten material onto molten thin ribbon.

28. The process as in claim 27 further including the step of cooling the chill block to solidify said molten thin ribbon.

29. The process as in claim 28 further including the step of heating said material into said molten state.

30. The process as in claim 29 further including the step of pulling the solidified thin ribbon strip from said chill block.

31. The process as in claim 27 including the step of selecting said molten material from the group consisting metals, semi-metals and semiconductors.

32. The process as in claim 31 including the step of selecting said molten material from silicon material.

* * * * *